US005957682A

United States Patent [19]

Kamal et al.

[11] Patent Number: 5,957,682

[45] Date of Patent: Sep. 28, 1999

[54] LOW NOX BURNER ASSEMBLY

[75] Inventors: Azfar Kamal, Arkansas City; Danny L. Christenson, Mulvane, both of Kans.

[73] Assignee: Gordon-Piatt Energy Group, Inc., Winfield, Kans.

[21] Appl. No.: 08/922,784

[22] Filed: Sep. 3, 1997

Related U.S. Application Data

[60] Provisional application No. 60/025,628, Sep. 4, 1996.

[51] Int. Cl.[6] ..... F23D 14/14

[52] U.S. Cl. ..... 431/328; 431/115

[58] Field of Search ..... 431/326, 327, 431/328, 329, 7, 8, 9, 115, 116

[56] References Cited

U.S. PATENT DOCUMENTS

| | | | |
|---|---|---|---|
| 1,678,996 | 7/1928 | McKinnie | 431/328 |
| 4,457,704 | 7/1984 | Sommers et al. . | |
| 5,015,174 | 5/1991 | Dreizler et al. | 431/116 |
| 5,073,105 | 12/1991 | Martin et al. | 431/116 |
| 5,102,329 | 4/1992 | Lifshits . | |
| 5,310,337 | 5/1994 | Lifshits et al. . | |
| 5,460,512 | 10/1995 | Lifshits et al. . | |
| 5,662,464 | 9/1997 | LaRose et al. | 431/8 |
| 5,667,374 | 9/1997 | Nutcher et al. | 431/8 |

FOREIGN PATENT DOCUMENTS

| | | | |
|---|---|---|---|
| 4009222 | 1/1991 | Germany | 431/116 |

*Primary Examiner*—Ira S. Lazarus
*Assistant Examiner*—Sara Raab
*Attorney, Agent, or Firm*—Crowe & Dunlevy

[57] ABSTRACT

An improved low NOx burner assembly having a burner plate assembly which is attached to a burner head portion thereof, the burner plate assembly having a burner plate and a wrapper, the burner plate having a relatively large central aperture and a plurality of smaller apertures of several diametrical sizes disposed at selected radial positions. The burner plate, attached to the burner head portion of the burner assembly via its wrapper, partially closes the outlet end of the burner head, and flame combustion is partially contained in a premixing chamber, thus effecting prolonged contact with combustion air prior to the gas and air mixture passing through the apertures of the burner plate.

19 Claims, 3 Drawing Sheets

LOW NOX BURNER ASSEMBLY

CROSS-REFERENCE TO RELATED APPLICATIONS

This application claims priority to U.S. Provisional Application Ser. No. 60/025,628 filed Sep. 4, 1996, hereby incorporated by reference.

BACKGROUND OF THE INVENTION

1. Field of the Invention

The present invention relates generally to fuel gas burners for low NOx production during combustion, and more particularly but not by way of limitation, to a burner assembly which has a burner plate assembly that reduces NOx combustibles.

2. Discussion

Oxides of nitrogen, collectively known as NOx, are major air-borne pollutants because of the harmful effects from acid rain, smog, vegetation destruction, ozone pollution, and health related issues. Traditionally, combustion, automobiles, and other fuel burning equipment are considered the primary sources of NOx emission. Boilers and steam generators have long been used for both industrial (food processing, heat treatment, etc.) and commercial (such as space heating) applications. As such equipment burns fuel with air to produce heat, significant amounts of pollutants, including NOx, are also produced.

The United States Environmental Protection Agency (EPA), established some 20 years ago by Congressional order, is the national regulatory authority on air quality. In November of 1990, on EPA's recommendations, Congress passed the Clean Air Act Amendments (CAAA). The processes producing pollutants were identified and timetables were established, setting limits on states to comply with air quality standards. The impact of CAAA has been felt by the boiler and burning manufacturing industry, as the owners and manufacturers of combustion equipment are potential regulatory targets for mandate control of NOx emissions limitations. Site permitting, regulatory compliance, and possible emission fees are viewed as potential consequences. In anticipation, the combustion industry is focusing its attention to curb NOx emission.

Several methods of NOx reduction have been devised, including both external and internal flue gas recirculation (FGR); steam injection (SI); fuel and air staging; premixing; controlled excess air firing; ceramic fiber; selective catalytic and non-catalytic reduction (SCR and SNCR); low NOx oil (for oil burning); and methods to introduce instabilities in the flow field, including the use of elliptical geometries, resonant generators, etc. These methods vary in cost as well as effectiveness in the reduction of NOx. From the perspective of a boiler/burner owner, the least expensive yet reliable method which enables the owner to reduce NOx to meet the prevailing air quality regulations is definitely the best for that application. The design improvements in NOx producing burners without expensive add-ons are certainly very appealing.

The formation mechanism of NOx is well described in combustion literature. It is now established that flames possess at least three possible routes of NOx formation: 1) Thermal NOx (Zeldovich's mechanism); 2) prompt NOx; and 3) fuel NOx.

In gaseous combustion, NOx formation from fuel NOx is insignificant, so only the first two mechanisms are of consequence. Thermal NOx is highly temperature dependent and often is the dominant mechanistic route. At temperatures below 1700 K≈2600° F. thermal NOx is insignificant, but it increases sharply above this temperature. Thermal NOx has a slow reaction rate constant, meaning it forms and dominates in the later portion of flames. Thermal NOx production is also sensitive to reactants (fuel and oxidizer) stoichiometry. Its peak occurs on the slightly fuel lean side of stoichiometry ($\phi<1$) and its concentration decays at off-stoichiometric conditions as either $\phi$ increases (fuel rich condition) or decreases (fuel lean condition). On the other hand, prompt NOx formation is a fast reaction and completes in the very early regions of flame, where fuel rich conditions exist and unbumt hydrocarbons, including the CN radicals, are in abundance.

Thus, from the above, it is clear that NOx formation (both thermal and prompt) in gaseous combustion can be reduced by: 1) Lowering flame temperature; 2) carefully setting the stoichiometry of fuel oxidizer (usually air) mixture; and 3) modifying the structure of flame in its early region so as to limit the formation of CN radicals.

The burner assembly of the present invention has demonstrated the ability to operate at sub 20 ppm levels of NOx without supplemental external reduction means such as flue gas recirculation, steam injection, or any other known means. The burner assembly incorporates a burner plate assembly that can be retro-fitted on conventional gas burners for low NOx operations, and is especially adapted for burners commonly employed in steam generators, commercial water heaters, absorption type water coolers/heaters and absorption type refrigerators.

BRIEF SUMMARY OF THE INVENTION

The present invention provides a burner assembly for reducing NOx as a product of combustion. The burner assembly has a burner plate assembly that is adaptable to mount to an existing conventional gas burner to reduce NOx emissions as the result of a simple add-on component.

The burner plate assembly has a relatively large central aperture, and then a plurality of additional apertures circumferentially arranged in different radial planes. The apertures vary significantly in size and radial location, so that the space between apertures varies. These variable spaces between apertures induce pressure differentials in the combustion gases so as to enhance recirculation of combustion gases into the flame.

The burner plate assembly attaches to the burner head of a conventional burner assembly so as to form a premixing chamber upstream of the combustion zone. The burner plate assembly is adapted for simple add-on attachment to an existing gas burner without complicated rework or modification, making a retrofit for lower NOx emissions desirable.

One object of the present invention is to manipulate the flame pattern of a gas burner so as to break the flame down into flamelets, thereby improving the fuel-air mixing.

A further object of the present invention, while achieving the above object, is to sufficiently increase the back pressure on fuel and air mixture streams thereby rendering more even mixing.

Another object of the present invention, while achieving the above stated objects, is to allow air-fuel staging to control stoichiometry, as needed to control NOx formation.

Another object of the present invention, while achieving the above stated objects, is to contain and process a portion of the flammable fuel-air mixture and flame within a premixing chamber, to reduce prompt NOx.

Another object of the present invention, while achieving the above stated objects, is to reduce the flame length, thereby reducing the flame residence time to reduce NOx emissions.

Another object of the present invention, while achieving the above stated objects, is to eject flamelets of different sizes at varying speeds, thereby creating pressure gradients within the combustion zone, thereby inducing exhaust gas recirculation to lower thermal NOx.

Other objects, advantages and features of the present invention will be apparent from the following description when read in conjunction with the drawings and appended claims.

The foregoing is illustrative only of the principles of the invention. Further, since numerous modifications and changes will readily occur to those skilled in the art it is not desired to limit the invention to the exact construction and operation shown and described. Accordingly, all suitable modifications and equivalents may be resorted to as they fall within the scope of the invention.

DESCRIPTION

Figure 1:
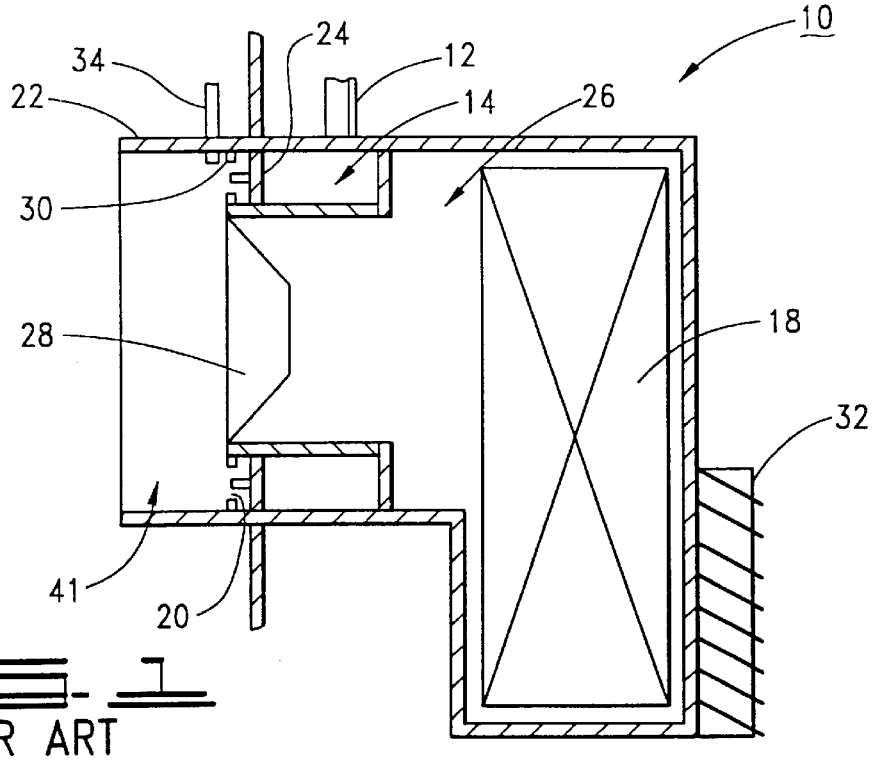
FIG. 1 PRIOR ART
FIG. 1 is a diagrammatical cross-sectional view of a conventional prior art low NOx gas burner assembly.

Referring to the drawings in general and in particular to FIG. 1, shown therein is a conventional fuel gas burner assembly 10, arranged for combustion of a fuel gas supplied by a conduit 12 a receiving gas manifold 14. Certain components common to burner assemblies of the type illustrated and discussed herein, such as controls, valves and mechanical linkages, are omitted herein as such details of construction are not believed to be necessary for the present disclosure but will be understood by those skilled in the art to be required for the proper construction and operation of the burner assemblies discussed.

Combustion air is supplied by a blower assembly having a blower wheel 18. Fuel gas is metered from the receiving gas manifold 14 through a plurality of fuel nozzles 20 which deliver the fuel gas into a combustion zone within a burner head portion 22 of the burner assembly 10. The fuel nozzles 20 are arranged circumferentially about and supported by an annular nozzle support plate 24. Fuel staging is conventionally achieved by arranging sets of orifices in different radial planes.

The combustion air is delivered by the blower wheel 18 into a combustion air plenum 26 which has an air diffuser 28 at its outlet end. Many conventional burner assemblies also include an air swirler adjacent the diffuser 28, but this is not included in the burner assembly 10 illustrated herein as such is not believed to be necessary for the present disclosure. The combustion air passed from the diffuser 28 mixes with the fuel gas beyond the fuel nozzles 20 and the mixture is combusted to produce a flame which typically stabilizes upon an apertured port plate 30 disposed near the ends of the fuel nozzles 20. It is also conventional in some burner assemblies for the flame to stabilize on the air diffuser 28. The amount of combustion air relative to the fuel gas flow is determined by a controlled louver box 32 on the air inlet side of the blower 18. To initiate combustion, a pilot flame assembly 34 is provided adjacent one or more of the fuel nozzles 20.

Figure 2:
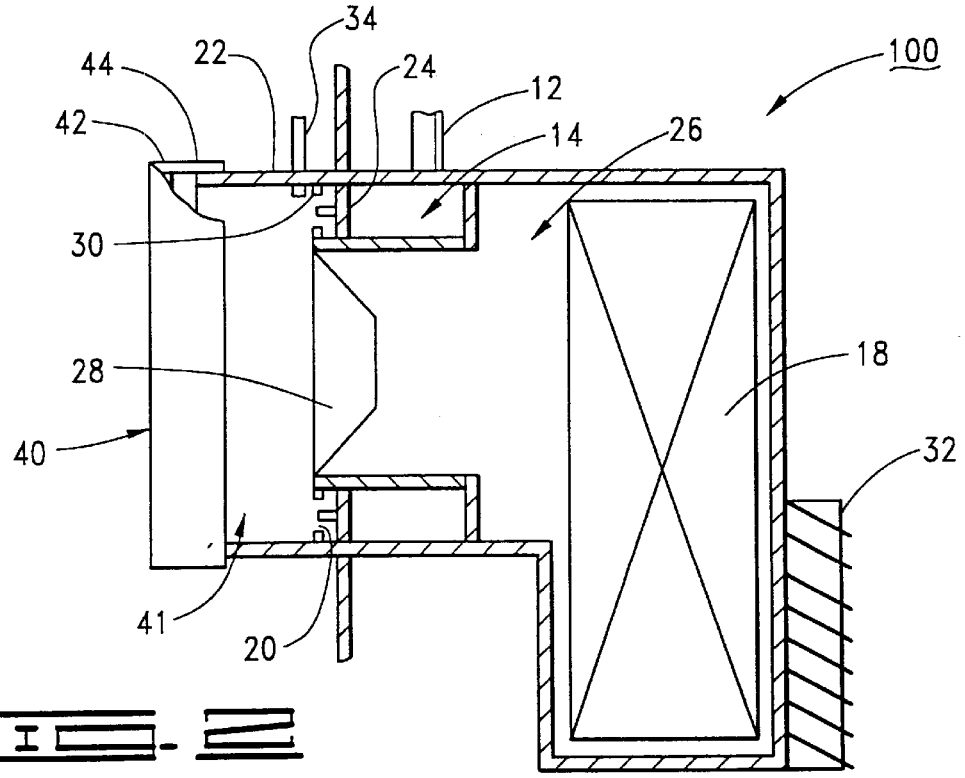
FIG. 2 is a diagrammatical, partial cross-sectional view of a low NOx burner assembly constructed in accordance with the present invention.

Turning now to FIG. 2, it will be recognized that the burner assembly 100 depicted therein is similar in construction to the burner assembly 10 of FIG. 1 and identical components thereof are provided with the same number designations in FIG. 2. Accordingly, the above description of the burner assembly 10 will be sufficient to describe the burner assembly 100 with the exception of a modification which will now be described. This modification is shown as the attachment of a burner plate assembly 40 to the burner head 22. Attachment of the burner plate assembly 40, described more fully below, forms a pre-mixing chamber 41 as indicated.

Figure 3:
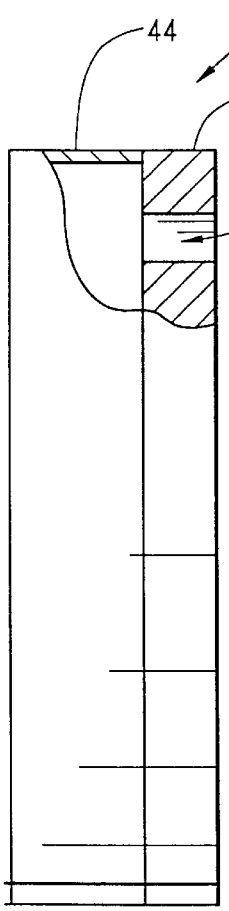
FIG. 3 is a side elevational view showing the burner plate assembly of the burner assembly of FIG. 2.

The burner plate assembly 40, as shown in FIG. 3, comprises a burner plate 42 attached to an annular wrapper 44. The preferred embodiment illustrated in FIG. 3 is indicated to be constructed of steel or other acceptable metal, but it will be appreciated that other materials are contemplated as equivalent thereto, such as a ceramic material or the like.

Figure 4:
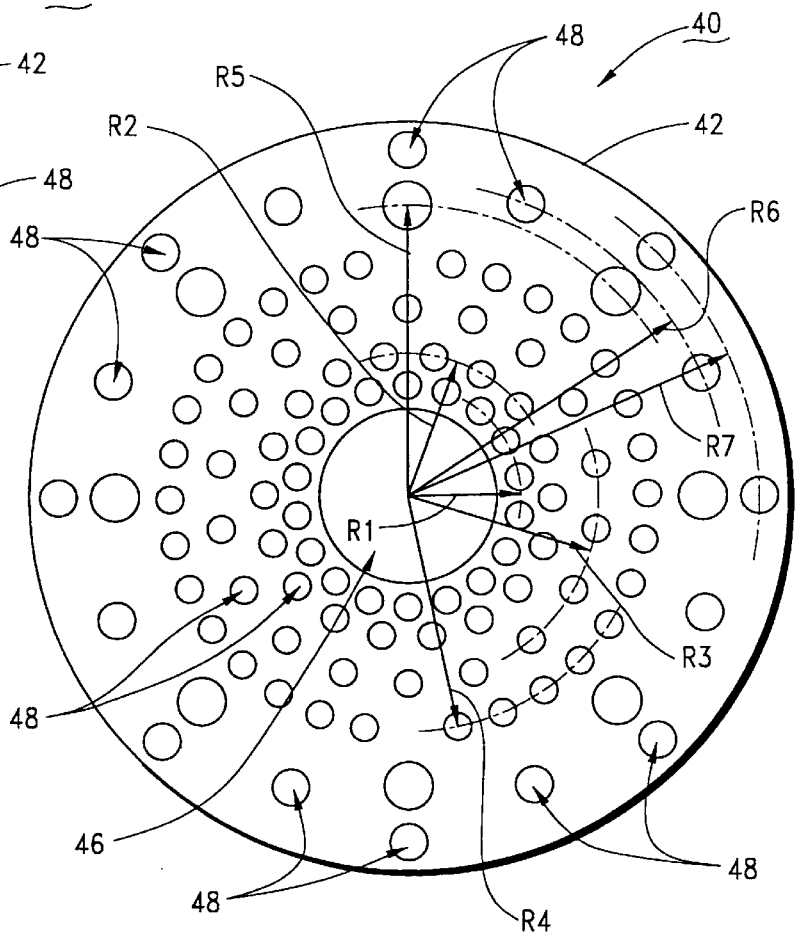
FIG. 4 is a front elevational view of the burner plate assembly of FIG. 3.

FIG. 4 shows a front elevational view of the burner plate assembly 40. It will be noted that the burner plate 42 is provided with a relatively large central aperture 46 which is surrounded circumferentially by a plurality of apertures 48 of selected sizes arranged upon selected radial positions. The size, number, and arrangement of the apertures 46, 48 may vary and as such do not limit the scope of the present invention. In actual practice of the present invention, the burner plate assembly 40, constructed illustrated in FIGS. 3 and 4 and attached to the burner head of a conventional burner assembly, produced NOx levels of less than 20 ppm.

The burner plate 42 depicted in FIG. 4 has an aperture layout for a 14 inch diameter burner head portion of a burner assembly. In this dimensional configuration, the central aperture 46 has a diameter of 2.344 inches. The inner ring of apertures 48 are arranged upon a radius R1 measuring 2.1 inches, and these apertures 48 are 31/64 inch in diameter, and are disposed 20 degrees apart. The next ring of apertures 48 on radius R2 (which is 3 inches) are likewise 31/64 inch in diameter and are 20 degrees apart. The third ring of apertures 48 arranged on radius R3 (which is 3.6 inches) are likewise 31/64 inch in diameter and 20 degrees apart. The fourth ring of apertures 48 are arranged on radius R4 (which is 4.578 inches) and are 31/64 inch in diameter and 10 degrees apart. The fifth ring of apertures 48 are arranged on radius R5 (which is 5.341 inches) and are 45/64 inch in diameter at 45 degrees apart. The sixth ring of apertures 48 are arranged on radius R6 (which is 5.628 inches) are 5/8 inch in diameter and are 45 degrees apart. Finally, the seventh ring of apertures 48 are arranged on radius R7 (which is 6.1 inches) and are likewise 5/8 inches in diameter at 45 degrees apart. This aperture pattern is illustrative only, and it will be understood that the particular aperture pattern that delivers the lowest NOx emissions for a particular burner will of necessity need to be to determined.

Figure 5:
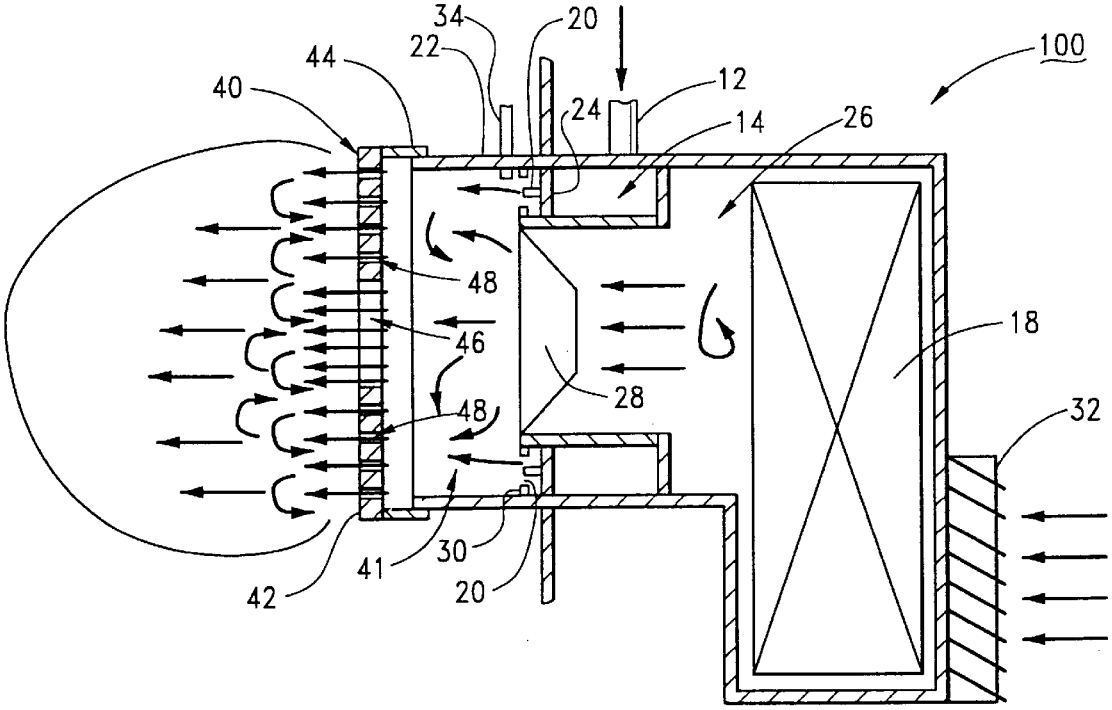
FIG. 5 is a diagrammatical cross-section view of the burner assembly of FIG. 2 further illustrating the combustion process stages and sequences.

Turning now to the operation of the burner assembly 100 of the present invention, FIG. 5 diagrammatically represents the combustion stages and sequence. The air and fuel staging is achieved the same as was described above for the burner assembly 10 of FIG. 1. The burner plate assembly 40, however, imparts an increased back pressure upon the fuel and air mixture within the premixing chamber 41.

It will be noted that the pilot flame assembly 34 is arranged upstream of the burner plate 42, so that in initiating combustion the flame is partially contained within the premixing chamber 41, so as to support partial combustion therein. This partially combusted mixture thereby comes into better contact with the combustion air, allowing minute scale mixing. Such mixing eliminates hot spots in the flame for an overall more uniform flame temperature.

The pressurized fuel and air mixture ejects through the apertures 46, 48 in the burner plate 42 at relatively high velocity. Higher velocity ensures more shearing effect between adjacent layers of the mixture, thereby further enhancing the mixture of fuel and air. Higher velocity furthermore reduces flame residence time, wherein less time is available for NOx formation.

The fuel and air mixture is combusted forming a flame which stabilizes on the outer surface of the burner plate 42. The aperture 48 pattern in the burner plate assembly 42 produces variable widths between apertures 48 across the face of the burner plate 42, generally increasing radially from the center of the burner plate outward. These spaces between apertures 48 on the burner plate 42 is where recirculation of combustion gases into the flame occurs. The characteristically varying zones produce localized pressure gradients which enhance the recirculation of combustion gases, thereby lowering the flame temperatures due to increased mass flow, and also by reducing the amount of oxygen available for combustion and for conversion of atmospheric $N_2$ into NOx.

Since the pilot flame is contained within the premixing chamber 41, the flame begins therein as discussed above. However, due to the high velocity and back pressure on the fuel and air mixture, the flame is stabilized only outside the premixing chamber 41 on the outer surface of the burner plate 42. Thus, a small portion of the gas and air mixture is combusted within the premixing chamber 41 while the rest of the gas and air mixture passes through the apertures 46, 48 before it is combusted.

A noteworthy feature of the present invention is that it has been employed as a retrofit conversion of a burner assembly having flue gas recirculation capability, where it was observed that NOx emissions were reducible to levels below 12 ppm at 3% $O_2$.

One skilled in the art will recognize the beneficial aspects of the construction and processes described above in reducing NOx emissions during fuel gas combustion. One advantage of the present invention is that the premixing chamber develops fully or substantially premixed flames rather than diffusion flames, the former having lower peak flame temperatures. Premixed flames also have shorter flame residence time and are shorter in length, meaning less time available for slower reactions like NOx formation to be completed. The premixing chamber furthermore permits enhanced fuel-air staging to control stoichiometry and the reduce NOx formation. The variable size and arrangement of apertures 46, 48 in the burner plate 42 facilitates recirculation and combustion of combustion gases.

The burner plate 42 ejects flamelets of different sizes at varying speeds, thereby creating pressure gradients within the combustion zone. This induces exhaust gas recirculation which helps to lower thermal NOx. Breaking down the flame into flamelets also improves the fuel-air mixing in the combustion zone. The burner plate assembly 40 sufficiently increases the back-pressure on the fuel and air streams to render more even mixing in the pre-mixing chamber 41. The burner plate assembly 40, in conjunction with the pilot flame assembly 34, contains and processes a portion of the mixture, which reduces prompt NOx. Although the flame temperature is reduced, the burner plate assembly 40 prevents incomplete combustion to inhibit the formation of soot and CO.

It is clear that the present invention is well adapted to carry out the objects and to attain the ends and advantages mentioned as well as those inherent therein. While a presently preferred embodiment of the invention has been described for purposes of the disclosure, it will be understood that numerous changes may be made which will readily suggest themselves to those skilled in the art and which are encompassed within the spirit of the invention disclosed and as defined in the appended claims.

What is claimed is:

1. A burner plate assembly which enables a modification of an existing gas burner assembly to reduce NOx emissions, wherein the gas burner assembly has an open burner head where a flame is formed in a combustion zone from combustion of a flammable gaseous mixture of fuel and air, and wherein the burner plate assembly comprises:

an annular wrapper attached to the burner head as an add-on attachment; and a burner plate supported by the wrapper, the burner plate having a central aperture transverse to the passageway and a first set of apertures in a concentric arrangement to the central aperture of a selected spacing and size, furthermore a second set of apertures in concentric arrangement to the central aperture of a different selected spacing and size, wherein the burner plate, the wrapper, and the burner head form an enclosed premixing chamber where the fuel and air are mixed prior to combustion, and the mixture passes through the burner plate to the combustion zone.

2. The burner plate assembly of claim 1 wherein the burner plate has a centrally disposed aperture, and has a first plurality of apertures formed circumferentially at a first radius and at a first angular spacing therebetween, and furthermore has a second plurality of apertures formed circumferentially at a second radius and at a second angular spacing therebetween, for introducing the mixture into the combustion zone.

3. The burner plate assembly of claim 1 wherein the burner plate has a centrally disposed aperture, and has a first plurality of apertures formed circumferentially at a first radius and at a first angular spacing therebetween, and furthermore has a second plurality of apertures formed circumferentially at a second radius and at a second angular spacing therebetween, wherein the mixture flows through the plurality of apertures and is combusted in the combustion zone to form a plurality of flamelets that form the flame.

4. The burner plate assembly of claim 1 wherein the gas burner assembly further comprises a pilot flame assembly disposed within the premixing chamber to combust a portion of the mixture within the premixing chamber.

5. The burner plate assembly of claim 1 wherein the mixture flowing through the plurality of apertures is combusted in the combustion zone, thereby producing a plurality of flamelets forming the flame.

6. The burner plate assembly of claim 1 wherein the gas burner assembly further comprises a gas manifold for receiving a delivery of fuel from a supply conduit, wherein the gas manifold comprises:

a nozzle support plate; and a plurality of fuel nozzles which meter the delivery of fuel into the premixing chamber.

7. The burner plate assembly of claim 1 wherein the gas burner assembly further comprises a blower assembly comprising:

an air plenum upstream of the passageway, which supports a diffuser at a distal end of the air plenum;

a blower wheel drawing combustion air from an inlet and providing a positive pressure air flow into the air plenum, wherein the air flow is diffused by the diffuser into the passageway; and a louver box disposed in the inlet for throttling the positive pressure air flow.

8. A burner assembly which burns a gaseous mixture of fuel and air in a flame within a combustion zone, wherein the burner assembly comprises:

a premixing chamber where the fuel and air are mixed to a selected stoichiometry;

a combustion air supply assembly which provides the air to the premixing chamber;

a gas fuel manifold which provides the fuel to the premixing chamber; and a burner plate assembly which restricts the air and fuel flow exiting the premixing chamber, wherein the burner plate assembly comprises a burner plate having a central aperture transverse to the passageway and a first set of apertures in a concentric arrangement to the central aperture of a selected spacing and size, furthermore a second set of apertures in concentric arrangement to the central aperture of a different selected spacing and size.

9. The burner assembly of claim 8 wherein the burner plate has a centrally disposed aperture, and has a first plurality of apertures formed circumferentially at a first radius and at a first angular spacing therebetween, and furthermore has a second plurality of apertures formed circumferentially at a second radius and at a second angular spacing therebetween, for introducing the mixture into the combustion zone.

10. The burner assembly of claim 8 wherein the burner plate has a centrally disposed aperture, and has a first plurality of apertures formed circumferentially at a first radius and at a first angular spacing therebetween, and furthermore has a second plurality of apertures formed circumferentially at a second radius and at a second angular spacing therebetween, wherein the mixture flows through the plurality of apertures and is combusted in the combustion zone to form a plurality of flamelets that form the flame.

11. The burner assembly of claim 8 further comprising a pilot flame assembly disposed within the premixing chamber to combust a portion of the mixture within the premixing chamber.

12. The burner assembly of claim 8 wherein the mixture flowing through the plurality of apertures is combusted in the combustion zone, thereby producing a plurality of flamelets forming the flame.

13. A low NOx forced-air burner assembly wherein a flame is formed from a combustion of air and gaseous fuel which are mixed to a desired stoichiometry upstream of a combustion zone and combusted in the combustion zone, the burner assembly comprising:

a burner head defining an annular passageway; and a burner plate assembly attached to a distal end of the burner head substantially enclosing the passageway and forming a premixing chamber, the burner plate assembly comprising a burner plate having a central aperture transverse to the passageway and a first set of apertures in a concentric arrangement to the central aperture of a selected spacing and size, furthermore a second set of apertures in concentric arrangement to the central aperture of a different selected spacing and size, wherein the combustion air and fuel are pressurized in the premixing chamber by a back pressure imparted by the burner plate, the combustion air and fuel mixing to the desired stoichiometry and partially combusting in the pre-mixing chamber and passing through the burner plate into the combustion zone where the flame stabilizes.

14. The low NOx burner assembly of claim 13 wherein the burner plate assembly further comprises a burner plate substantially spanning the passageway at a distal end of the burner head, and wherein the burner plate has a center and forms a first set of apertures at a first radial diameter from the center and are circumferentially spaced a first distance apart, wherein the burner plate furthermore forms a second set of apertures at a second radial diameter from the center and are circumferentially spaced a second distance apart, wherein a portion of the mixture flows through the first set of apertures and another portion of the mixture simultaneously flows through the second set of apertures, and wherein the spacing of the first set of apertures and the spacing of the second set of apertures creates a pressure differential in the mixture within the combustion zone that imparts recirculation to the exhaust gases into the flame to reduce the NOx emissions from the combustion.

15. The low NOx burner assembly of claim 1 further comprising a pilot flame assembly disposed within the passageway to combust a portion of the mixture within the passageway.

16. The low NOx burner assembly of claim 13 wherein the mixture flows through the plurality of apertures and is combusted in the combustion zone to produce a plurality of flamelets that form the flame.

17. The low NOx burner assembly of claim 13 wherein the burner plate assembly further comprises an annular wrapper attached to the burner head as an add-on attachment and supporting in turn, the burner plate.

18. The low NOx burner assembly of claim 13 further comprising a gas manifold disposed in the annular passageway in fluid communication with a delivery of fuel, wherein the gas manifold comprises:

a nozzle support plate; and a plurality of fuel nozzles which meters the delivery of fuel into the passageway.

19. The low NOx burner assembly of claim 13 further comprising a blower assembly comprising:

an annular member depending from the burner head to provide an air plenum upstream of the passageway, the annular member supporting a diffuser at a distal end of the air plenum;

a blower wheel drawing combustion air from an inlet and providing a positive pressure air flow into the air plenum, wherein the air flow is diffused by the diffuser into the passageway; and a louver box disposed in the inlet for throttling the positive pressure air flow.

* * * * *